US008752212B2

(12) United States Patent
Byrnes

(10) Patent No.: US 8,752,212 B2
(45) Date of Patent: Jun. 17, 2014

(54) DEVICE AND METHOD FOR SECURING THE POSITION OF JOINT PADS IN SPORTS

(76) Inventor: Matthew Byrnes, Slatersville, RI (US)

( * ) Notice: Subject to any disclaimer, the term of this patent is extended or adjusted under 35 U.S.C. 154(b) by 427 days.

(21) Appl. No.: 13/199,675

(22) Filed: Sep. 7, 2011

(65) Prior Publication Data

US 2013/0055481 A1 Mar. 7, 2013

(51) Int. Cl.
*A41D 13/08* (2006.01)
*A41D 13/05* (2006.01)

(52) U.S. Cl.
CPC ..... *A41D 13/0575* (2013.01); *A41D 13/08* (2013.01)
USPC ..... 2/16; 2/125

(58) Field of Classification Search
CPC ..... A41D 13/0575; A41D 13/0562; A41D 13/0568; A41D 13/055; A41D 13/0556; A41D 13/0587; A41D 13/065; A41D 13/08; A41D 27/10
USPC ..... 2/16, 22, 23, 24, 69, 94, 108, 125, 126, 2/227, 232, 59, 62, 267, 115, 455
See application file for complete search history.

(56) References Cited

U.S. PATENT DOCUMENTS

| | | | | |
|---|---|---|---|---|
| 1,089,999 | A * | 3/1914 | Watts | 2/126 |
| 1,147,155 | A * | 7/1915 | Farlow | 2/126 |
| 1,149,674 | A * | 8/1915 | Nichols | 2/59 |
| 1,951,437 | A * | 3/1934 | Parfitt | 2/269 |
| 3,670,339 | A * | 6/1972 | Cooper et al. | 2/22 |
| 5,105,473 | A * | 4/1992 | Valtakari | 2/461 |
| 5,388,271 | A * | 2/1995 | Sessoms | 2/115 |
| 5,539,927 | A * | 7/1996 | Holubec | 2/69 |
| 5,611,080 | A | 3/1997 | Skottheim | |
| 5,701,606 | A * | 12/1997 | Aldridge | 2/81 |
| 6,070,273 | A | 6/2000 | Sgro | |
| 6,076,185 | A | 6/2000 | Schramm | |
| 7,181,774 | B2 * | 2/2007 | Silver | 2/227 |
| 7,353,546 | B2 | 4/2008 | Hunt | |
| 7,356,849 | B2 | 4/2008 | Morrow et al. | |
| 7,748,056 | B2 | 7/2010 | Mickle | |
| 2004/0003454 | A1 | 1/2004 | Morrow et al. | |
| 2006/0053526 | A1 * | 3/2006 | Beland et al. | 2/115 |
| 2008/0040829 | A1 | 2/2008 | Morrow et al. | |
| 2010/0024101 | A1 * | 2/2010 | Berner et al. | 2/455 |
| 2010/0083414 | A1 | 4/2010 | Hunt | |

(Continued)

OTHER PUBLICATIONS

Unk, hockeymonkey, Internet, http://ep.yimg.com/ca/I/hockeymonkey_2169_83596873, Aug. 10, 2011, CA.

(Continued)

*Primary Examiner* — Amy Vanatta
(74) *Attorney, Agent, or Firm* — Stan Collier, Esq.

(57) ABSTRACT

The invention utilizes a long sleeve modified shirt for the foundation garment. A separate tubular sleeve has one end sewn about the modified sleeve approximately at the elbow. The other end, the free end, of the tubular sleeve may then extend beyond the end of the modified sleeve. The arm is inserted into the modified sleeve and through the tubular sleeve. The elbow pad is attached about the elbow joint over the modified sleeve and over the tubular sleeve end sewn at the elbow area. The free end of the tubular sleeve is pulled over the elbow pad and attaches to the area near the Biceps/Shoulders with straps having removable attachment means thereon. The straps are attached to allow for adjustment. Essentially, the tubular sleeve forms a partial pouch about the elbow pad thus holding and preventing the elbow pad from shifting.

16 Claims, 5 Drawing Sheets

(56) References Cited

U.S. PATENT DOCUMENTS

| | | | | |
|---|---|---|---|---|
| 2010/0319104 | A1 | 12/2010 | Beland et al. | |
| 2012/0180181 | A1* | 7/2012 | Best et al. | 2/16 |

OTHER PUBLICATIONS

Unk, shockdoctor. Internet, http://www.shockdoctor.com/product/shockskin-hockey-impact-shirt.aspx, Aug. 10, 2011, US.

* cited by examiner

RIGHT SIDE VIEW

PRIOR ART

PRIOR ART

DEVICE AND METHOD FOR SECURING THE POSITION OF JOINT PADS IN SPORTS

CROSS REFERENCES TO RELATED APPLICATIONS

None.

REFERENCE TO FEDERALLY SPONSORED RESEARCH OR DEVELOPMENT

NA

REFERENCE TO JOINT RESEARCH AGREEMENTS

NA

REFERENCE TO SEQUENCE LISTING

NA

BACKGROUND OF THE INVENTION

1. Field of the Invention

The present invention relates generally to protective devices used in sports, and, more particularly, to protective devices for joint protection and the securing of the device thereon, and, in greater particularity, relates to devices for securing elbow pads.

2. Description of the Prior Art

Participants in certain sports risk injury to joints from a variety of causes. Protective gear such as elbow pads and knee pads are commonly worn. One of the most violent sports is ice hockey where the player may be hurt by collisions with other players, intentional or not, collisions with arena equipment such as walls, ice, and goals and being hit by sticks and pucks. Another sport having a high probability of the player being hurt is lacrosse. The types and amounts of protective gear are balanced by the need to remain agile. Thus one of the most common types of protective gear are elbow pads.

Almost all elbow pads are held to the elbow joint location by straps or elastic bands or a combination of these. The elastic band may be sewn at both ends onto the pad, or one end of the strap is sewn onto the pad and the other end has Velcro™ means for attachment. Additionally, the straps may be adjustable through the use of Velcro™ means, and/or through adjustable buckles. Such devices are shown in U.S. Pat. Nos. 5,611,080; 6,070,273; and 6,076,185 (interior joint protection), for example. FIG. 4 illustrates a Bauer™ Vapor elbow pad 10 having both elastic bands 12 and 14, and an adjustable strap 16.

During use, movement of the arms causes the elbow pad to move downward which is caused by moisture between the arm and pad, the upper arm being larger than the lower arm, and gravity. Over tightening of the straps may prevent movement, but also interferes with the player's movements.

In order to restrict the movement of the elbow pads when in use, and when a shirt is worn under the elbow pads, the shirt may have high-friction areas to prevent the slipping of the pads as shown by U.S. Pat. No. 7,748,056 and also U.S. Patent Application 2010/0319104.

The pads also may have additional means therein to increase the friction to the arms. U.S Patent Application 2004/0003456 shows two frictional elements on the inside of the upper arm section and the lower arm section of the pads. See continuation U.S. Patent Application 2008/0040829.

External straps/harnesses may be used to hold the pads such as shown by U.S. Patent Application 2007/0011798, also as U.S. Pat. No. 7,353,546, where a harness like device is placed over the head of the user. Straps on the harness can be connected to the elbow pads to hold them up. The attachment devices may be detachable so that prior pads may be used. See also U.S. Patent Application 2010/0083414 by the same inventor also showing a strapped harness.

Even with all the contraptions as shown above to address the problem of migrating elbow pads, an additional means was arrived at by the players wherein they turned up the lower sleeves of the long sleeve shirts, FIG. 3, worn under the elbow pad. This is shown in FIG. 2. But because of the very vigorous movements in ice hockey, this still has not prevented the movement of the elbow pads. All of the above prior art is incorporated by reference.

Accordingly, there is an established need for a means for securing joint pads, and especially elbow pads, from moving during play.

SUMMARY OF THE INVENTION

The present invention is directed at a device and method for securing the position of joint pads in sports.

The present invention although primarily directed at the elbow joint pads, other joints may be similarly protected. One embodiment of the present invention utilizes a shirt modified for the foundation garment. A separate tubular sleeve made of elastic material has one end sewn about the standard sleeve approximately two thirds of the distance from the wrist to the elbow preferably, but it may be attached below, at, above or near the elbow. The other end, the free end, of the tubular sleeve may then extend beyond the end of the standard sleeve. One then inserts the arm into the modified sleeve in use. After this, the elbow pad is attached about the elbow joint over the modified sleeve and the tubular sleeve. Then, one pulls the free end of the tubular sleeve over the elbow pad, and attaches the free end of the tubular sleeve having several Velcro™ means on straps. These straps are connected to Velcro™ pads attached to the modified sleeve about the upper arm area approximately between the mid-biceps to the lower shoulder. The pads are sufficiently long to allow for adjustment of the straps. In effect, the tubular sleeve forms a partial pouch about the elbow pad with the modified sleeve being the other part thereof.

An object of the present invention is to provide a means for securing a joint pad for use in sports.

It is another object of the present invention to provide a means for securing an elbow pad.

It is a further object of the present invention to provide a means for securing an elbow pad that is easily attached about the elbow pad.

It is still a further object of the present invention to provide a means for securing an elbow pad that is adaptable to any brand of professional elbow pads.

It is yet a further object of the present invention to provide a means for securing an elbow pad that is operable in high impact sports such as hockey.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

The present invention is directed at a device and method for securing the position of joint pads in sports such as hockey.

As a further embodiment, the present invention is directed at the securement of an elbow pad.

Figure 4:
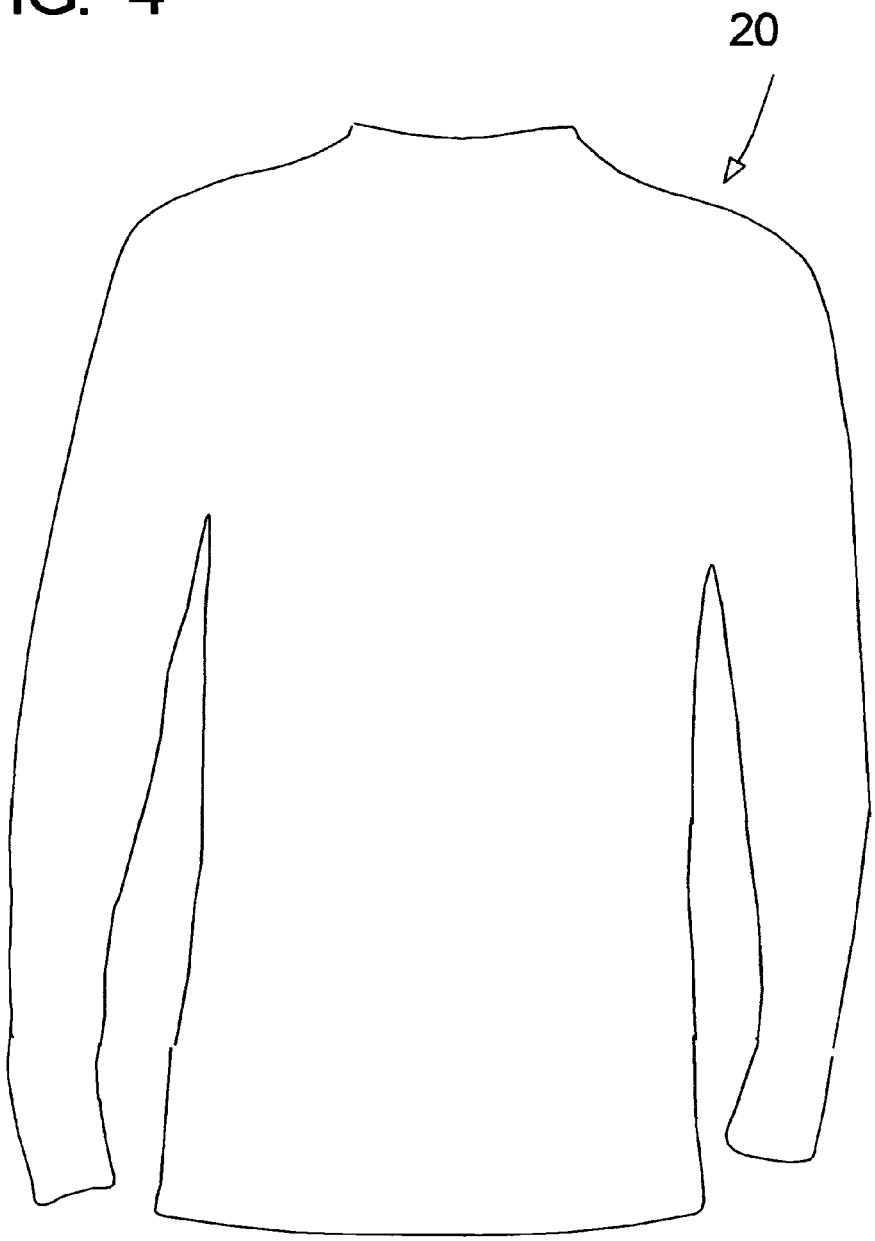
FIG. 4 is a front view of a hockey shirt with long sleeves before being modified for use with the present invention.

Turning to the drawings, wherein like components are designated by like reference numerals throughout the various figures, attention is initially directed to FIG. 4. FIG. 4 shows a front view of a long sleeve hockey shirt 20 being of conventional design such as sold by Shockdoctor™ under the brand name of Shockskin™. A hockey shirt may come in either a short sleeve or a long sleeve style that the present invention will address.

Figure 1:
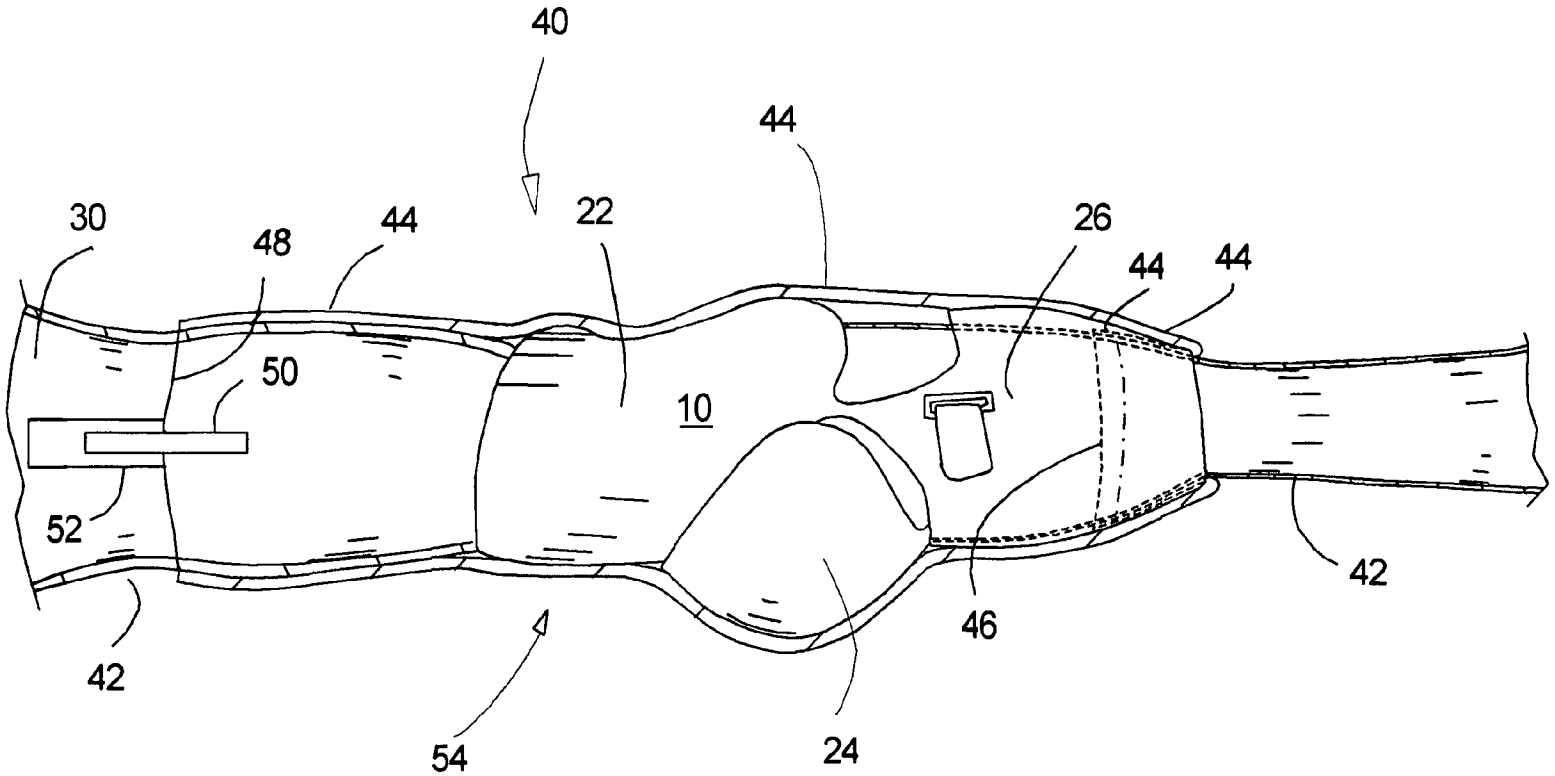
FIG. 1 is a partial view of the present invention.

As best shown in FIG. 1 and in general, the present invention although primarily directed at the elbow pads, other joints may be similarly protected. The preferred embodiment of the present invention utilizes a long sleeve shirt for the foundation garment. A separate tubular sleeve made of elastic material has one of the open ends of the tubular sleeve, being called the first end, sewn about the standard long sleeve approximately two thirds of the distance from the wrist to the elbow. The second end, the free end, of the tubular sleeve then extends beyond the end of the modified sleeve, the sleeve with the first end attached, as will be shown. One then inserts the arm into the modified sleeve in use. After this, the conventional elbow pad is attached about the elbow joint over the modified sleeve and the tubular sleeve near the first end. Then, after the elbow pad is secured to the elbow area, one pulls the second end of the tubular sleeve over the elbow pad and attaches the second end of the tubular sleeve having several Velcro™ means or straps thereon to Velcro™ pads attached to the modified sleeve about the upper arm area approximately between the mid-biceps to the lower shoulder. The straps and pads are sufficiently long to allow for adjustment due to different arm lengths, shirt sleeve lengths, etc. In effect, the tubular sleeve forms a partial pouch about the elbow pad with the modified sleeve being the other part of the pouch thereof. The tubular sleeve is further made of an elastic material such as spandex or Lyrca™ and tightly fits about the elbow pad to prevent its movement within the pouch. These combine to prevent the movement of the elbow pad, especially in the downward direction, during sports activities.

Figure 3:
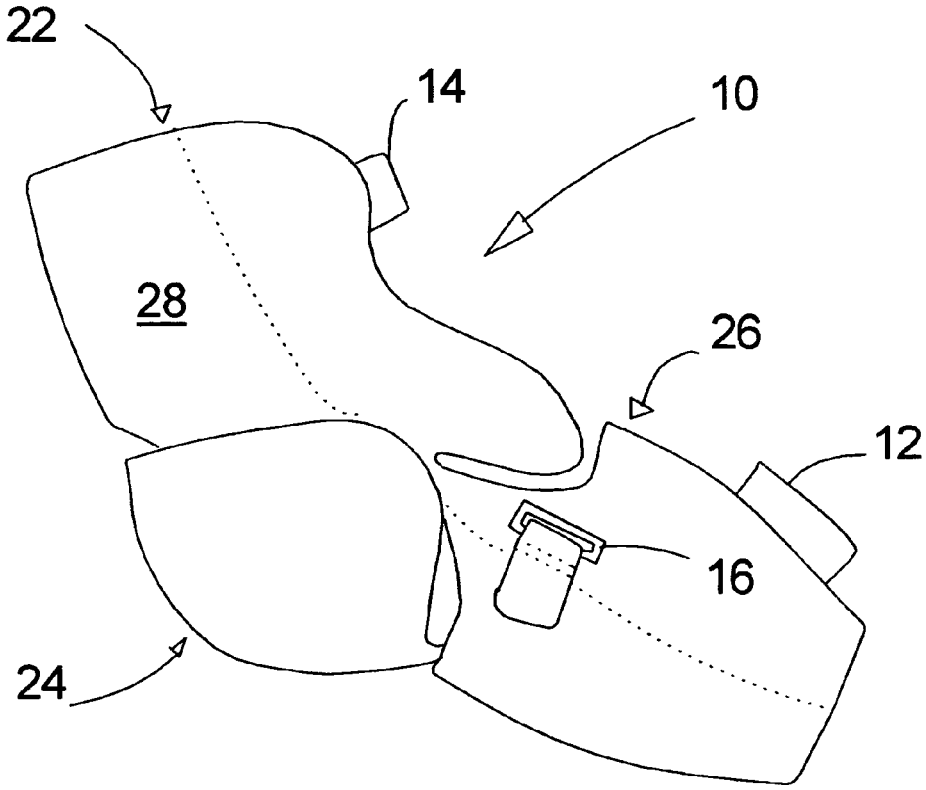
FIG. 3 is a side view of a conventional elbow pad that may be used with the present invention.

As noted above, there are numerous elbow pads available on which the present invention may be applied. An example of one elbow pad is one made by Bauer called the Vapor™. See FIG. 3. This elbow pad 10 is approximately 12 inches long. This elbow pad 10 is merely used to show the functional use with the present invention and is not by itself unique. The elbow pad 10 has an upper arm section 22, an elbow protector 24 and a lower arm section 26. An outer cloth covering 28 holds the arm section 22, protector 24 and the lower arm section 26 together as shown and allows the sections to flex. The elbow pad 10 is held to the arm by means of two elastic bands 12 and 14 having one end sewn to the outer covering 28 and the other end with Velcro™ means such as straps thereon for removable attachment to pads placed upon the arm sections. The use of the term Velcro™ means indicates that there are separate hook and loop sections or straps and pads with the hook and/or loop material attached thereon. The adjustable strap 16 is included to further secure the elbow pad 10 to the arm.

Figure 2:
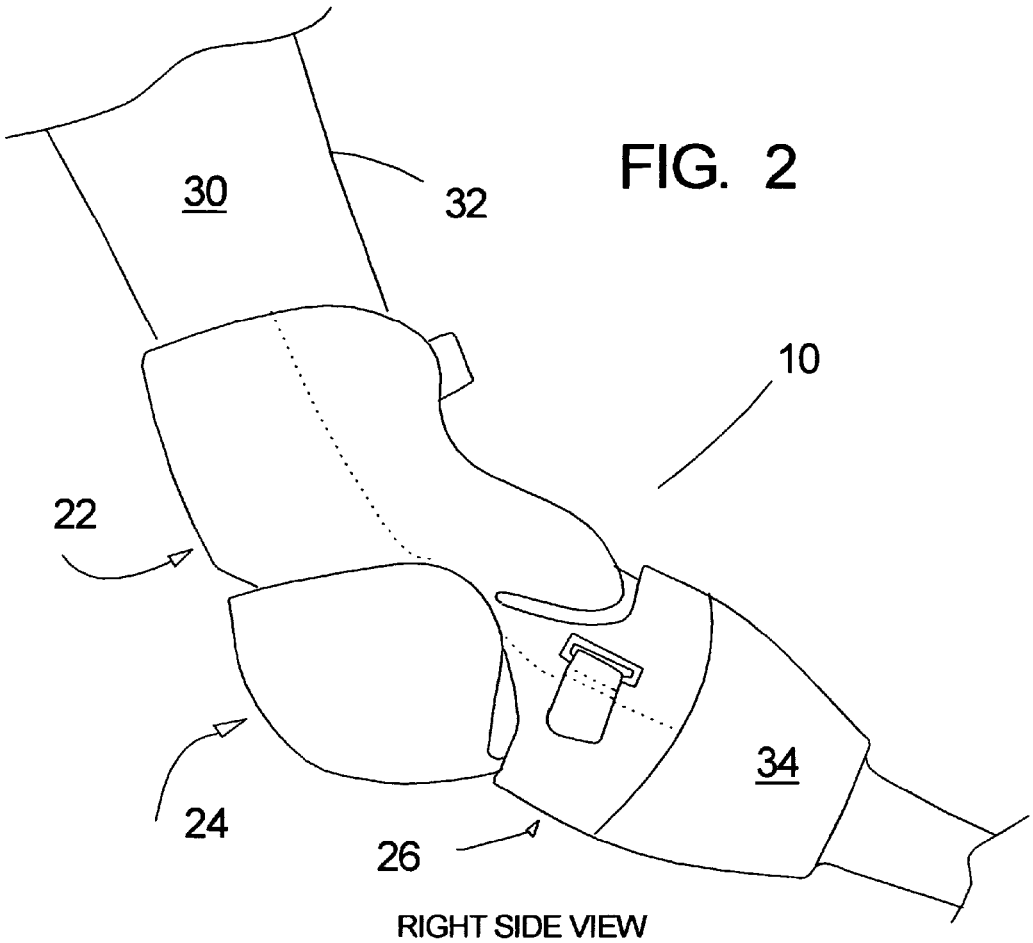
FIG. 2 PRIOR ART
FIG. 2 is a side view of the elbow pad of FIG. 3 placed over the hockey shirt of FIG. 4 having the lower arm sleeve pulled up and partially over the elbow pad.

One attempt at a possible solution to the migrating elbow pad 10 is shown in FIG. 2, but this solution fails to prevent the elbow pad 10 from moving. As seen in FIG. 2, the elbow pad 10 is positioned on an arm 30 over a long sleeve 32. A lower section 34 of the sleeve 32 extends beyond the lower arm section 26 and is then pulled over a portion of the lower arm section 26 as seen also in FIG. 3. Since the sleeve 32 is made of an elastic material, it grips the lower arm section 26 and does prevent to a degree, not sufficiently, the downward movement of the elbow pad 10 during play.

Referring to FIG. 1, one embodiment of a device 40 of the present invention is shown in partial view as well be explained below. The device 40 for securing the location of the elbow pad 10, a joint pad in general, upon a limb such as the arm 30 and has a foundation garment 42 such as a modified long sleeve 42 thereon. The modified long sleeve 42 extends from a shoulder, not shown, to a wrist, not shown. A tubular sleeve 44, as seen in cross section, is also made of an elastic material such as noted above. The tubular sleeve 44 has a first end 46 fixedly attached to said foundation garment or modified sleeve 42 at a position below, at or above or near the joint. A preferred position being approximately two thirds the distance from the wrist to the elbow. A second end 48 of said tubular sleeve 44 is removable attached to the modified sleeve 42 above the joint approximately between the lower shoulder and mid-Biceps with Velcro™ means such as with two or more straps 50 on the second end 48 to two or more pads 52 secured to the modified sleeve 42.

The elbow pad 10 is attached over the elbow joint, not shown, and over the modified sleeve 42, and over the first end 46 of the tubular sleeve 44 fixedly attached to the modified sleeve 44. The second end 48 of the tubular sleeve 44 is initially located below the wrist, but then is pulled over the elbow pad 10 to the position shown in FIG. 1. In this manner, second end 48 of said tubular sleeve 44 is then removably attached to the modified sleeve 42 above the joint so forming a pouch 54 in cooperation with the modified sleeve 42 to prevent the unwanted movement of the joint pad during sports activity. The modified sleeve 42 being held in position by the above shoulder, not shown. It should be understood that by pulling the second end 48 upwards for removable attachment, the modified sleeve 42 is pulled downwards to a degree under the lower arm section 26 so as to firmly grip the elbow pad 10 within the pouch 54. The upper arm being of greater diameter than the lower arm helps prevent the upward movement of the pad 10 once it is secured with the bands 12 and 14 and strap 16 and pouch 54.

Figure 5A:
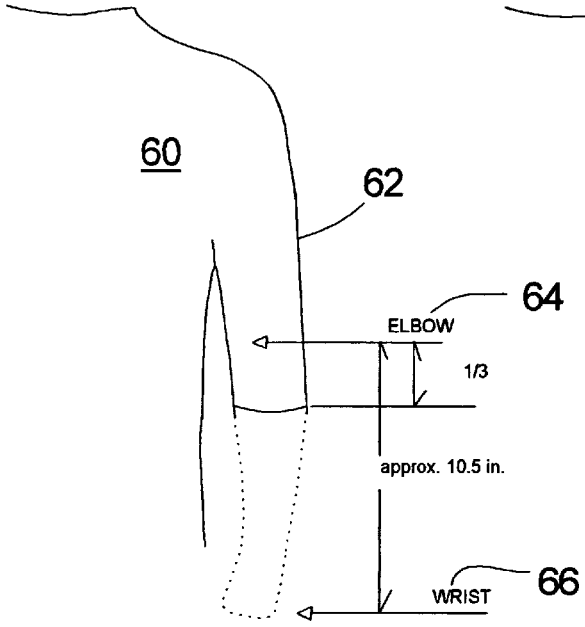
FIGS. 5A and 5B show a modified hockey shirt and its use with the present invention.
Figure 5B:
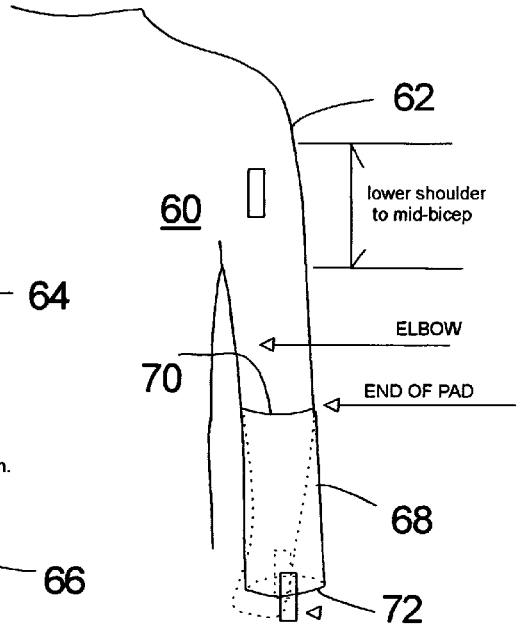

Although a long sleeve shirt is shown above, a short sleeve shirt 60 can also be used in another embodiment as seen in FIGS. 5A and 5B. In this embodiment, a short sleeve 62 extends below the elbow position 64 approximately one third the distance from the elbow position to the wrist position 66.

FIG. 5A. FIG. 5B shows a tubular sleeve 68 having the first end 70 fixedly attached to the short sleeve 62 below the elbow, or attached to the short sleeve 62 at the elbow or above the elbow. The second end 72 of the tubular sleeve 68 is shown extending downward without a portion of the short sleeve 62 therein. The elbow pad 10 is again attached to the elbow position and the second end 72 pulled over the elbow pad 10 to secure its position as shown and discussed previously.

Clearly, one shirt whether long sleeve or short sleeve does not fit all. The modified shirts for the present invention will come in a variety of sizes such as small, medium, large, and extra large wherein the first end of the tubular sleeve is appropriately attached whether for a long sleeve or short sleeve. A custom fitted modified shirt may be required in cases as needed. The first end may be fixedly attached to the sleeve below said joint by sewing, by glue, by hook and loop material, by buttons, and by snaps. Also, the second end may be removably attached to the upper sleeve above the joint by means such as hook and loop material, by buttons, and by snaps. Also, the second end may be removably attached to the modified sleeve by means such as a hook and loop material where straps are attached to the tubular sleeve and pads are attached upon the sleeve. The pads may be fixedly attached to an area approximately located between a lower shoulder and mid-Biceps. Whether the Further, the present invention encompasses a method for preventing the movement of a joint pad during sports activity wherein a player wears a modified shirt having a sleeve with a tubular sleeve attached thereon; the player then attaches an elbow pad upon the modified shirt sleeve. The player then pulls the second end of the tubular sleeve upwards to enclose the elbow pad within the tubular sleeve and securing the tubular sleeve to the modified shirt sleeve to prevent movement of the elbow pad. The tubular sleeve may be made of an elastic material as conventionally known so that the elastic tubular sleeve firmly encloses and presses the elbow pad upon the arm.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A device for securing the location of a joint pad upon a limb, the device comprising:

a garment upon the limb, said garment overlapping a joint of the limb;

a tubular sleeve, said tubular sleeve having a first end attached to said garment at a position near or at the joint, having a second end of said tubular sleeve removably attached to said garment above the joint and on an outside of said garment;

wherein the joint pad is attached over the joint and over said garment, and over the first end of the tubular sleeve fixedly attached to said garment, said second end of said tubular sleeve is pulled over the joint pad, said second end of said tubular sleeve then removably attached to the garment above the joint so forming a pouch in cooperation with said garment to prevent the unwanted movement of the joint pad during sports activity therein and upon the limb.

2. The device as recited in claim 1, wherein said garment is a shirt.

3. The device as recited in claim 2, wherein said garment has long sleeves or short sleeves.

4. The device as recited in claim 3, wherein said limb is an arm and wherein said joint is an elbow.

5. The device as recited in claim 1, wherein said tubular sleeve is made of an elastic material.

6. The device as recited in claim 1, wherein said first end is fixedly attached to said sleeve near or at said joint by sewing, by glue, by hook and loop material, by buttons, or by snaps.

7. The device as recited in claim 1, wherein said second end is removably attached to said sleeve above said joint by hook and loop material, by buttons, or by snaps.

8. The device as recited in claim 7, wherein said second end is removably attached to said sleeve by a hook and loop material, such means attached to a plurality of straps, a set of straps being upon or near the second end of said tubular sleeve, a set of pads being fixedly attached upon the sleeve.

9. The device as recited in claim 3, wherein said first end is fixedly attached to said long sleeve at a point about two thirds up from the wrist to the joint.

10. The device as recited in claim 3, wherein said first end is fixedly attached to a short sleeve near or at an end.

11. The device as recited in claim 3, wherein said first end is fixedly attached near to or at said end of the short sleeve.

12. The device as recited in claim 8, wherein said set of pads are fixedly attached to an area approximately located between a lower shoulder and mid-Biceps.

13. The device as recited in claim 3, wherein said tubular sleeve is adapted to form a pouch about an elbow pad in cooperation with said sleeve.

14. A method for preventing the movement of a joint pad during sports activity, said method comprising the steps of:

wearing a shirt having a sleeve with a tubular sleeve attached thereon;

attaching an elbow pad to an elbow having the shirt sleeve thereunder; and enclosing the elbow pad within said tubular sleeve and removably securing the tubular sleeve to said shirt sleeve to prevent movement of the elbow pad.

15. The method as defined in claim 14, further including the step of providing a said tubular sleeve made of an elastic material.

16. The method as defined in claim 15, wherein said tubular sleeve firmly encloses and presses upon the elbow pad upon the arm.

* * * * *